US005530533A

United States Patent [19]

Wallace

[11] Patent Number: 5,530,533

[45] Date of Patent: Jun. 25, 1996

[54] HIGH SOLIDS TONER REDISPERSION

[75] Inventor: Anthony M. Wallace, Penfield, N.Y.

[73] Assignee: Xerox Corporation, Stamford, Conn.

[21] Appl. No.: 399,263

[22] Filed: Mar. 6, 1995

[51] Int. Cl.[6] ..... G03G 15/10

[52] U.S. Cl. ..... 355/256; 118/661

[58] Field of Search ..... 355/256; 118/659, 118/661; 430/117

[56] References Cited

U.S. PATENT DOCUMENTS

| | | | |
|---|---|---|---|
| 3,825,191 | 7/1974 | Smith et al. | 241/46.11 |
| 4,860,050 | 8/1989 | Kurotori et al. | 355/256 |
| 5,004,165 | 9/1991 | Landa et al. | 241/21 |
| 5,048,762 | 9/1991 | Landa et al. | 241/21 |
| 5,078,504 | 1/1992 | Landa et al. | 366/118 |
| 5,262,268 | 11/1993 | Bertranid et al. | 430/137 |
| 5,304,451 | 4/1994 | Felder et al. | 430/137 |
| 5,345,296 | 9/1994 | Wellings | 355/256 |
| 5,436,706 | 7/1995 | Landa et al. | 355/256 |

FOREIGN PATENT DOCUMENTS

| | | | |
|---|---|---|---|
| 1-38773 | 2/1989 | Japan | 355/256 |

*Primary Examiner*—Joan H. Pendegrass
*Attorney, Agent, or Firm*—John S. Wagley

[57] ABSTRACT

An apparatus for breaking aggregated toner in a liquid carrier into smaller pieces is provided. The apparatus includes a screen defining a plurality of apertures therein with the smaller pieces of toner being passable therethrough and a member. The member and the screen have a movable relation therebetween which is parallel to a surface of the screen to urge at least a portion of the toner through the screen.

19 Claims, 3 Drawing Sheets

HIGH SOLIDS TONER REDISPERSION

Figure 1:
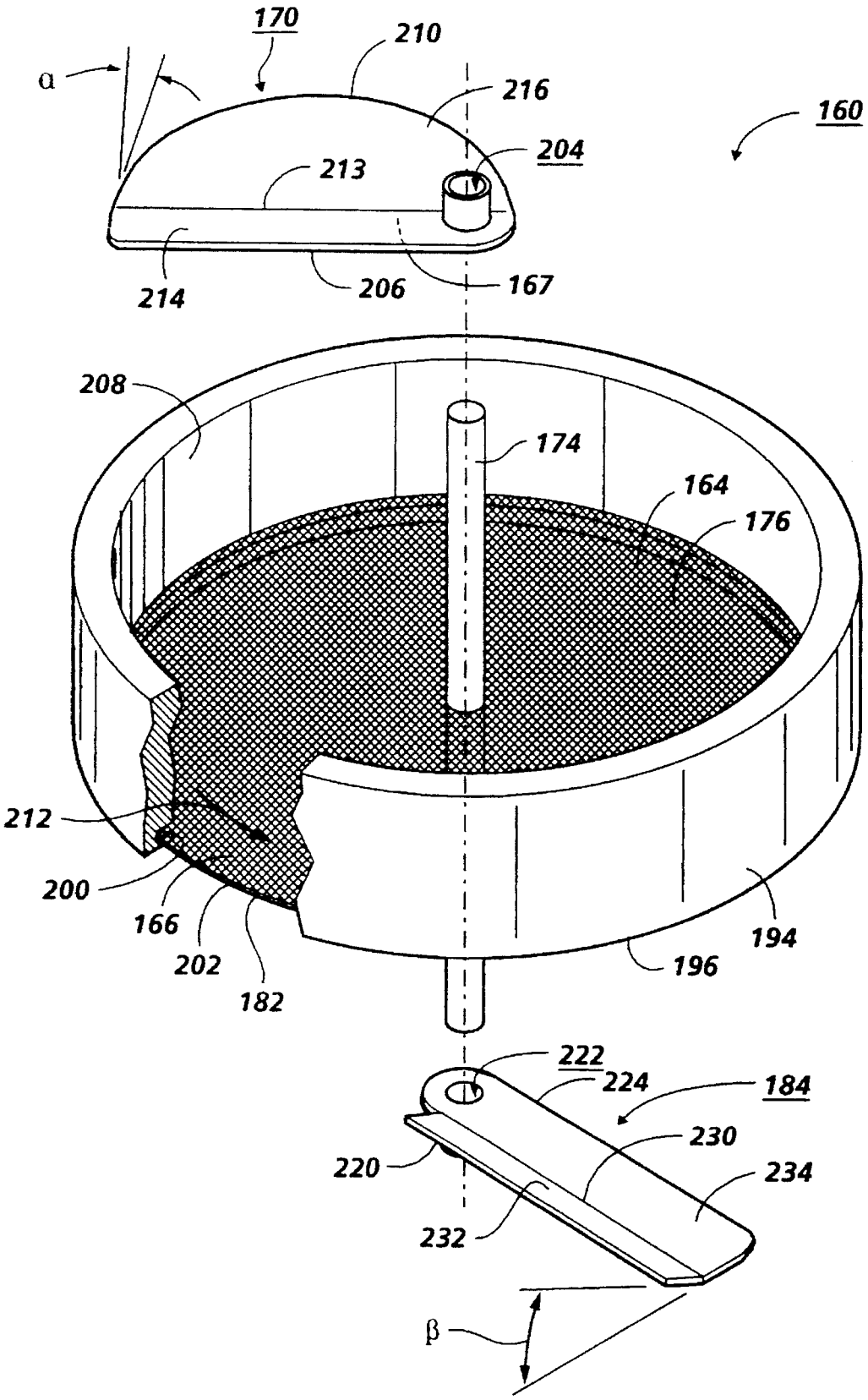

This invention relates generally to a printing machine, and more particularly concerns a development system for developing images with a liquid developer material comprising at least a liquid carrier having toner particles dispersed therein.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon, in the irradiated area, to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with a dry developer material comprising carrier granules having toner particles adhering triboelectrically thereto. The toner particles are attracted to the latent image forming a visible powder image on the photoconductive surface. After the electrostatic latent image is developed with the toner particles, the toner powder image is transferred to a copy sheet. Thereafter, the toner powder image is heated to permanently fuse it to the copy sheet. Alternatively, the electrostatic latent image may be developed by furnishing a liquid ink developer material thereto.

Another type of printing process is electrostatic printing which involves utilizing a plurality of closely spaced electrodes or styli opposed from a wide electrode across which an electrical potential is selectively applied sufficient to ionize the air, gas or other fluid therebetween. An insulating web or sheet is passed between these electrodes, or alternatively, the electrodes are passed over the insulating web or sheet, and when the electrodes are energized an electrostatic charge is deposited on the web or sheet in the electrode configuration on the area between the energized electrodes. In this manner, a charge pattern is formed on the dielectric material in accordance with the presence, absence, or intensity of the potential applied across the electrodes. The charge pattern, or electrostatic latent image, may then be developed into visual form by the application to the web or sheet of toner particles, which adhere in conformance with the latent image. The resultant developed image is then fused permanently affixing the toner powder image to the sheet.

In the foregoing types of printing machines, it is desirable to be capable of utilizing a liquid developer material. In order to successfully utilize liquid developer materials, the development systems must be capable of handling the liquid material. Various types of printing machines, electrostatic printing machines, and liquid development systems have heretofore been employed.

This invention is generally directed to liquid developer processes, and, more specifically, the present invention relates to the preparation of ink dispersions. More specifically, the present invention relates processes and apparatus for obtaining excellent ink dispersions by breaking up agglomerates.

BACKGROUND OF THE INVENTION

Liquid electrostatic developers having chargeable toner particles dispersed in an insulating nonpolar liquid are well known in the art and are used to develop latent electrostatic images. Ideally, such liquid developers should be replenishable in the particular equipment in which they are used.

In general, high solids concentration toners are used for replenishment because relatively low concentrations (e.g., in the range of 10 to 15% by weight solids) require the use of much larger replenishment containers and/or require much more frequent replacement than high solids concentration toners. Thus, it is desirable to initially use a toner containing less liquid, and to maintain the working source located within the equipment, thereby minimizing the undesirable accumulation of carrier liquid in the equipment.

When toners are present in the liquid developer in more concentrated form, however, they become difficult to redisperse in the carrier. For example, aggregates may be formed. This can cause serious problems in the replenishment of the liquid developer in the equipment being use.

It has been known to use high shear forces between two closely spaced cylindrical surfaces to dissociate liquid toner particles as disclosed in U.S. Pat. Nos. 5,004,165, 5,048,762, and 5,078,504. These methods have been found acceptable for some applications. However, these dispersion apparatus have the disadvantage in that they require high tolerance, costly mechanical parts to create hydrodynamic sheer and thereby disperse the toner. A need to provide a less expensive method for dispersing liquid toner still remains.

The following disclosures appear to be relevant:

U.S. Pat. No. 5,345,296

Patentee: Wellings

Issued: Sep. 6, 1994

U.S. Pat. No. 5,304,451

Patentee: Felder et al.

Issued: Apr. 19, 1994

U.S. Pat. No. 5,262,268

Patentee: Bertrand et al.

Issued: Nov. 16, 1993

U.S. Pat. No. 5,078,504

Patentee: Landa et al.

Issued: Jan. 7, 1992

U.S. Pat. No. 5,048,762

Patentee: Landa et al.

Issued: Sep. 17, 1991

U.S. Pat. No. 5,004,165

Patentee: Landa et al.

Issued: Apr. 2, 1991

The relevant portions of the foregoing patents may be briefly summarized as follows:

U.S. Pat. No. 5,345,296 discloses a device for dispersing high solids toner into a working developer solution. The dispersion device includes a rotatable member, a mechanism for rotating the rotatable member and a stationary member for creating the high shear force. The high shear force between the stationary and rotatable member disperses the high solids toner into a working developer solution.

U.S. Pat. No. 5,304,451 discloses a method of replenishing a liquid developer. Dry toner particles including a friable thermoplastic resin and a colorant are added to the liquid developer. The dry particles are prepared by reducing the resin and colorant to a coarse powder and milling the powder into dry fine particles.

U.S. Pat. No. 5,262,268 discloses method of dispersing a pigment into colored toner. A wet pigment cake is blended and extruded directly with a resin and other constituents in the manufacture of a toner.

U.S. Pat. No. 5,078,504 discloses a dispersion device for dispersing a first material in a second material. The device includes an enclosure having an apertured divider. The divider divides the enclosure into first and second sub-enclosures. Each material enters through a different sub-enclosure. A means enhances passage of material through the divider.

U.S. Pat. No. 5,048,762 discloses a dispersion device for dispersing solids in liquids. Solids dispersed in a liquid are placed between two relatively movable cylinders. Spherical dispersing elements are positioned between the two cylinders. The cylinders are separated by a distance which is slightly greater than the minimum dimension of the dispersing elements.

U.S. Pat. No. 5,004,165 discloses a dispersion device for dispersing solids in liquids. Solids dispersed in a liquid are placed between two relatively movable cylinders. Cylindrical dispersing elements are positioned between the two cylinders. The cylinders are separated by a distance which is slightly greater than the minimum dimension of the dispersing elements.

SUMMARY OF THE INVENTION

In accordance with one aspect of the present invention, there is provided an apparatus for breaking aggregated toner in a liquid carrier into smaller pieces. The apparatus includes a screen defining a plurality of apertures therein with the smaller pieces of toner being passable therethrough and a member. The member and the screen have a movable relation therebetween which is parallel to a surface of the screen to urge at least a portion of the toner through the screen.

In accordance with another aspect of the present invention, there is provided a developer unit of the type having a developer material of toner and liquid carrier with the toner developing a latent image recorded on a member to form a developed image. The developer unit includes a transport for transporting at least the toner closely adjacent to the latent image and a device for supplying toner to the transport. The device breaks the toner in the liquid carrier into smaller pieces of toner. The device includes a screen defining a plurality of apertures therein with the smaller pieces of toner being passable therethrough and a member associated with the screen for urging at least a portion of the toner through the screen.

In accordance with yet another aspect of the present invention, there is provided an electrophotographic printing machine of the type having a developer material of toner and liquid carrier with the toner developing an electrostatic latent image recorded on a photoconductive member. The machine includes a transport for transporting at least the toner closely adjacent to the latent image and a device for supplying toner to the transport. The device breaks the toner in the liquid carrier into smaller pieces of toner. The device includes a screen defining a plurality of apertures therein with the smaller pieces of toner being passable therethrough and a member associated with the screen to urge at least a portion of the toner through the screen.

Figure 2:
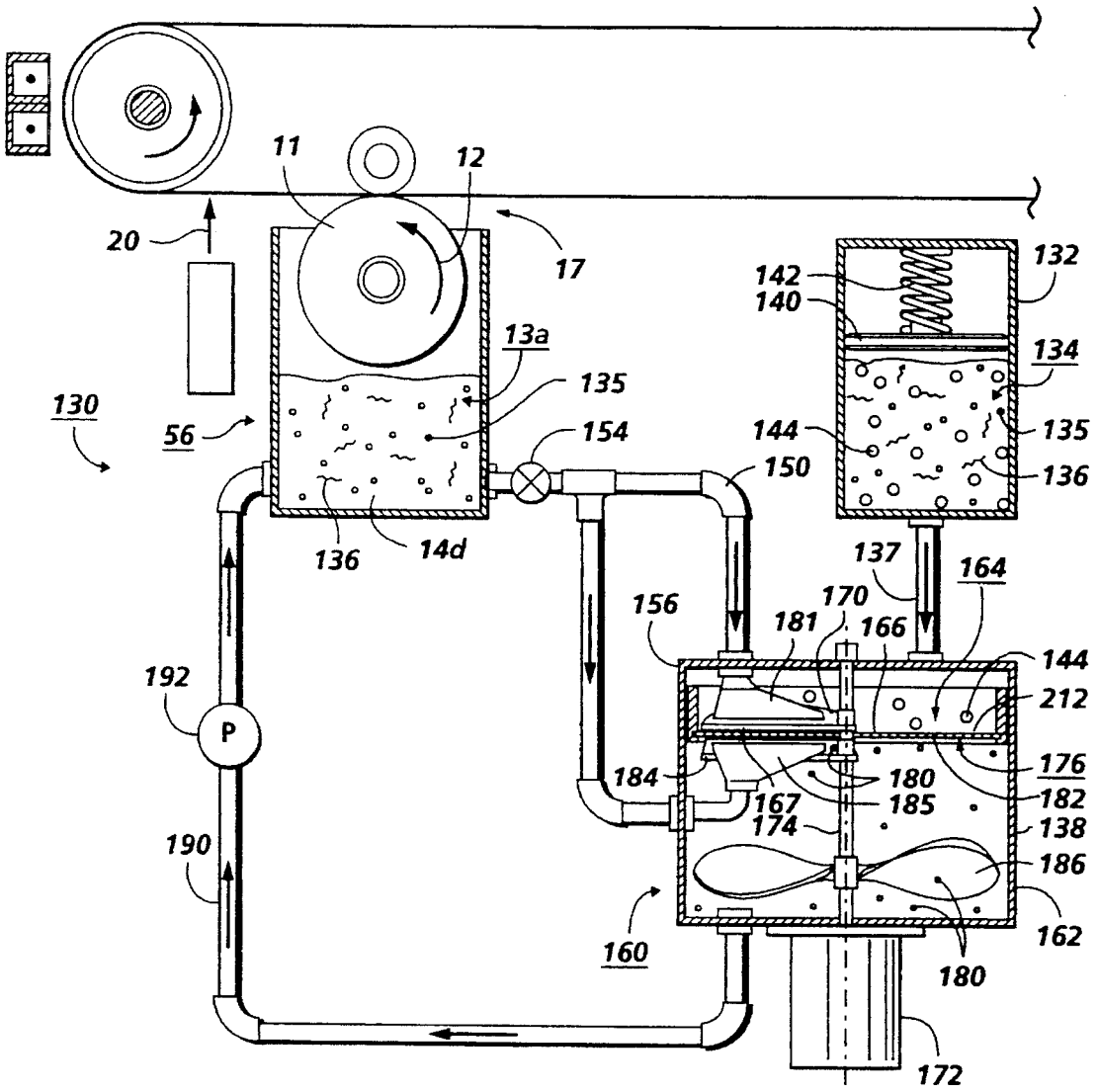
Figure 3:
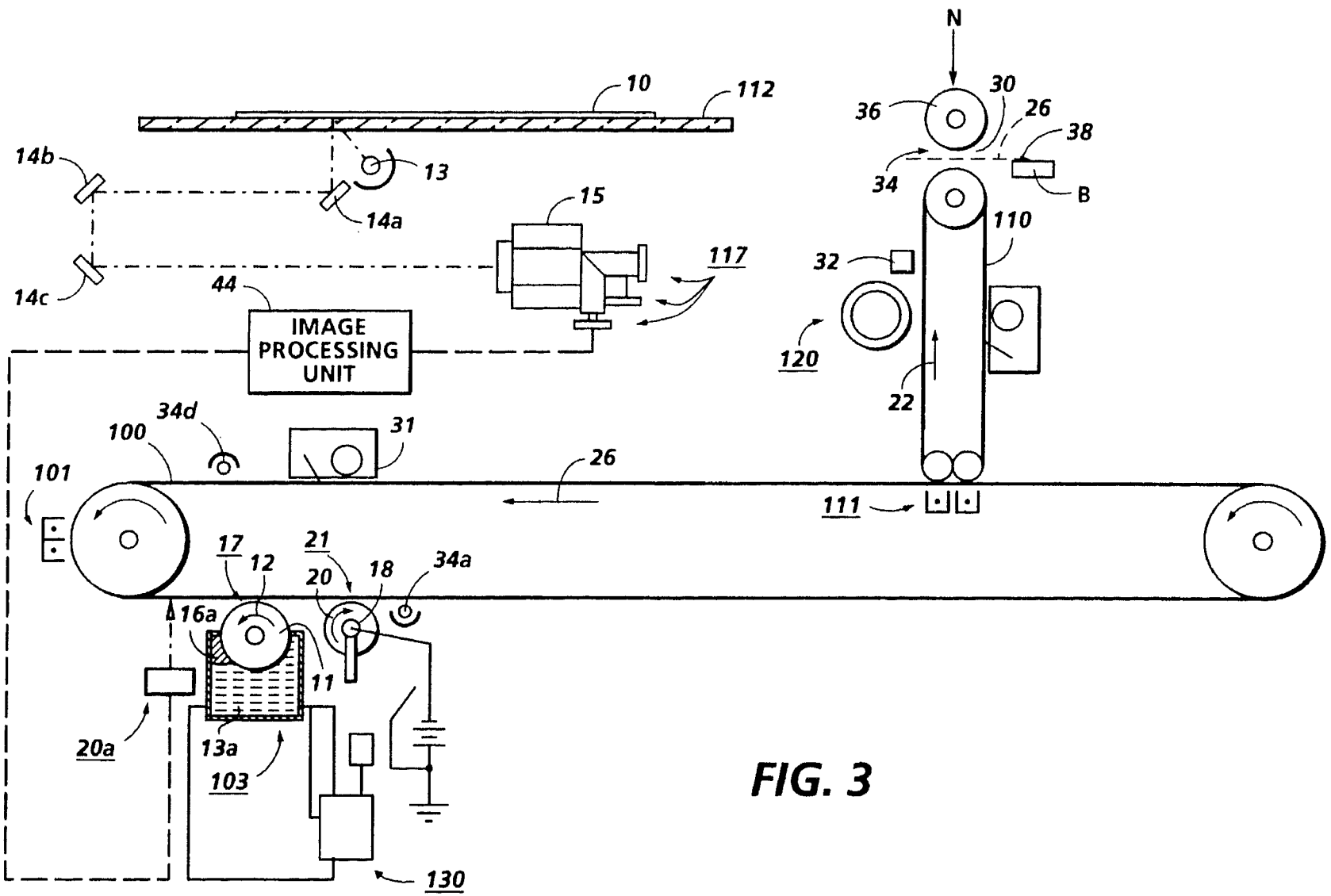

The invention will be described in detail herein with reference to the following Figures in which like reference numerals denote like elements and wherein:

FIG. 1 is an exploded perspective view of a high solids dispersion device according to the present invention;

FIG. 2 is a schematic elevational view of a developer replenishing system for an electrophotographic printing machine incorporating the high solids dispersion device of the present invention therein; and FIG. 3 is a schematic elevational view of an illustrative electrophotographic printing machine having a photoconductive surface and incorporating the high solids dispersion device of the present invention therein.

While the present invention will hereinafter be described in connection with various embodiments thereof, it will be understood that it is not intended to limit the invention to these embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements.

The present invention is applicable to all printing systems utilizing a liquid developer.

For a general understanding of the features of the present invention, reference numerals have been used throughout to designate identical elements. FIG. 3 schematically depicts the various elements of an illustrative electrophotographic printing machine incorporating the present invention therein. It will become evident from the following discussion that the present invention is equally well suited for use in a wide variety of printing machines including highlight and full process color printing machines and is not necessarily limited in its application to the particular embodiment depicted herein.

Inasmuch as the art of electrophotographic printing is well known, the various processing stations employed in the FIG. 3 printing machine will be shown hereinafter schematically and their operation described briefly with reference thereto.

Turning now to FIG. 3, there is shown a document imaging system incorporating the present invention. The copy process can begin by either inputting a computer generated image into the image processing unit 44 or by way of example, placing a document 10 to be copied on the surface of a transparent platen 112. A scanning assembly consisting of a halogen or tungsten lamp 13 which is used as a light source, and the light from it is exposed onto the document 10; the light reflected from the document 10 is reflected by the 1st, 2nd, and 3rd mirrors 14*a*, 14*b* and 14*c*, respectively, then the light passes through lenses 15 to a charged-coupled device (CCD) 117 where the information is read. The CCD 117 outputs an analog voltage which is proportional to the intensity of the incident light. The analog signal from the CCD 117 is converted into an 8-bit digital signal for each pixel (picture element) by an analog/digital converter. The digital signal enters an image processing unit 44. The digital signals are converted in the image processing unit into bitmaps. The bitmap represents the value of exposure for each pixel. Image processing unit 44 may contain a shading correction unit, a masking unit, a dithering unit, a gray level processing unit, and other imaging processing sub-systems known in the art. The image processing unit 44 can store bitmap information for subsequent images or can operate in a real time mode.

The photoconductive member, preferably a belt of the type which is typically multilayered and has a substrate, a conductive layer, an optional adhesive layer, an optional hole blocking layer, a charge generating layer, a charge transport layer, and, in some embodiments, an anti-curl backing layer. Belt 100 is charged by charging unit 101. Raster output scanner (ROS) 20*a*controlled by image processing unit 44, writes image bitmap information by selectively erasing charges on the belt 100. The ROS 20*a* writes the image information pixel by pixel in a line screen registration mode. It should be noted that either discharged area development (DAD) can be employed in which discharged portions are developed or charged area development (CAD) can be employed in which the charged portions are developed with toner. After the electrostatic latent image has been recorded, belt 100 advances the electrostatic latent image to development station 103. At development station 103, roller 11, rotating in the direction of arrow 12, advances a liquid developer material 13*a* from the chamber of housing or cartridge 14*d* to development zone 17. An electrode 16*a* positioned before the entrance to development zone 17 is electrically biased to generate an AC field just prior to the entrance to development zone 17 so as to disperse the toner particles substantially uniformly throughout the liquid carrier. The toner particles, disseminated through the liquid carrier, pass by electrophoresis to the electrostatic latent image. When using charged area development (CAD) the charge of the toner particles is opposite in polarity to the charge on the photoconductive surface.

The liquid developers suitable for the present invention generally comprise a liquid vehicle, toner particles, a charge director. The liquid medium may be any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 99 percent by weight, although this amount may vary from this range provided that the objectives of the present invention are achieved.

The toner particles can be any particle compatible with the liquid medium, such as those contained in the developers disclosed, for example, in U.S. Pat. Nos. 3,729,419; 3,841,893; 3,968,044; 4,476,210; 4,707,429; 4,762,764; and 4,794,651; and U.S. application Ser. No. 08/268,608, the disclosures of each of which are totally incorporated herein by reference. The toner particles can consist solely of pigment particles, or may comprise a resin and a pigment; a resin and a dye; or a resin, a pigment, and a dye. Preferably all of these forms of toner particles include charge control agents CCA.

Examples of suitable charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like.

Suitable resins include poly(ethyl acrylate-co-vinyl pyrrolidone), poly(N-vinyl-2-pyrrolidone), and the like. Other examples of suitable resins are disclosed in U.S. Pat. No. 4,476,210, the disclosure of which is totally incorporated herein by reference. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight.

The toner particles should have an average particle diameter from about 0.2 to about 10 microns, and preferably from about 0.5 to about 2 microns. The toner particles may be present in amounts of from about 1 to about 10, and preferably from about 1 to about 2 percent by weight of the developer composition.

Examples of suitable charge directors include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge director may be present in an amount of from about 0.01 to about 3 percent by weight, and preferably from about 0.02 to about 0.05 percent by weight of the developer composition.

After the image is developed, it is conditioned at development station 103. Development station 103 also includes porous roller 18 having perforations through the roller skin covering. Roller 18 receives the developed image on belt 100 and conditions the image by reducing fluid content while inhibiting the departure of toner particles from the image, and by compacting the toner particles of the image. Thus, an increase in percent solids is provided to the developed image, thereby improving the quality of the developed image. Preferably, the percent solids in the developed image is increased to more than increased to 20 percent solids. Porous roller 18 operates in conjunction with vacuum (not shown) for removal of liquid from the roller. A roller (not shown), in pressure against the blotter roller 18, may be used in conjunction with or in the place of the vacuum, to squeeze the absorbed liquid carrier from the blotter roller for deposit into a receptacle. Furthermore, the vacuum assisted liquid absorbing roller may also find useful application where the vacuum assisted liquid absorbing roller is in the form of a belt, whereby excess liquid carrier is absorbed through an absorbent foam layer. A belt used for collecting excess liquid from a region of liquid developed images is described in U.S. Pat. Nos. 4,299,902 and 4,258,115, the relevant portions of which are hereby incorporated by reference herein.

In operation, roller 18 rotates in direction 20 to impose against the "wet" image on belt 100. The porous body of roller 18 absorbs excess liquid from the surface of the image through the skin covering pores and perforations. Vacuum located on one end of the central cavity of the roller, draws liquid that has permeated through roller 18 out through the cavity and deposits the liquid in a receptacle or some other location which will allow for either disposal or recirculation of the liquid carrier. Porous roller 18, discharged of excess liquid, continues to rotate in direction 20 to provide a continuous absorption of liquid from image on belt 100. The image on belt 100 advances to lamp 34*a* where any residual charge left on the photoconductive surface is extinguished by flooding the photo-conductive surface with light from lamp 34*a*.

It should be appreciated that the development may take place in a similar fashion for additional colors for example magenta. It should be evident to one skilled in the art that for color development systems, the color of toner at each development station could be arranged in different configurations. The resultant image is electrostatically transferred to the intermediate member by charging device 111. The present invention takes advantage of the dimensional stability of the intermediate member to provide a uniform image deposition stage, resulting in a controlled image transfer gap and better image registration. Further advantages include reduced heating of the recording sheet as a result of the toner or marking particles being pre-melted, as well as the elimination of electrostatic transfer of charged particles to a recording sheet. Intermediate member 110 may be either a rigid roll or an endless belt having a path defined by a plurality of rollers in contact with the inner surface thereof. It is preferred that intermediate member comprises a two layer structure in which the substrate layer has a thickness greater than 0.1 mm and a resistivity of $10^6$ ohm-cm. An insulating top layer has a thickness less than 10 micron, a dielectric constant of 10, and a resistivity of $10^{13}$ ohm-cm. The top layer also has a liquid-phobic release surface. Also, it is preferred that both layers have matching hardness less than 60 durometer. Preferably, both layers are composed of Viton™ (a fluoroelastomer of vinylidene fluoride and hexafluoropropylene) which can be laminated together. The multi layer image is conditioned by blotter roller 120 which receives the multi level image on intermediate member 110 and conditions the image by reducing fluid content while inhibiting the departure of toner particles from the image, and by compacting the toner particles of the image. Blotter roller 120 conditions the multi layer so that the image has a toner composition of more than 50 percent solids.

Subsequently, the image, present on the surface of the intermediate member, is advanced through image liquefaction stage B. Within stage B, which essentially encompasses the region between when the toner particles contact the surface of member 110 and when they are transferred to recording sheet 26, the particles are transformed into a tackified or molten state by heat which is applied to member 110 internally. Preferably, the tackified toner particle image is transferred and bonded to recording sheet 26 with limited wicking by the sheet. More specifically, stage B includes a heating element 32, which not only heats the external wall of the intermediate member in the region of transfix nip 34, but because of the mass and thermal conductivity of the intermediate member, generally maintains the outer wall of member 110 at a temperature sufficient to cause the toner particles present on the surface to melt. The toner particles on the surface, while softening and coalescing due to the application of heat from the exterior of member 110, maintain the position in which they were deposited on the outer surface of member 110, so as not to alter the image pattern which they represent. The member continues to advance in the direction of arrow 22 until the tackified toner particles 30 reach transfix nip 34. At transfix nip 34, the liquefied toner particles are forced, by a normal force N applied through backup pressure roll 36, into contact with the surface of recording sheet 26. Moreover, recording sheet 26 may have a previously transferred toner image present on a surface thereof as the result of a prior imaging operation, i.e. duplexing. The normal force N, produces a nip pressure which is preferably about 100 psi, and may also be applied to the recording sheet via a resilient blade or similar spring-like member uniformly biased against the outer surface of the intermediate member across its width.

As the recording sheet passes through the transfix nip the tackified toner particles wet the surface of the recording sheet, and due to greater attractive forces between the paper and the tackified particles, as compared to the attraction between the tackified particles and the liquid-phobic surface of member 110, the tackified particles are completely transferred to the recording sheet as image marks 38. Furthermore, as the image marks were transferred to recording sheet 26 in a tackified state, they become permanent once they are advanced past transfix nip and allowed to cool below their melting temperature. The transfixing of tackified marking particles has the further advantage of only using heat to pre-melt the marking particles, as opposed to conventional heated-roll fusing systems which must not only heat the marking particles, but the recording substrate on which they are present.

After the developed image is transferred to intermediate member 110, residual liquid developer material remains adhering to the photoconductive surface of belt 100. A cleaning roller 31 formed of any appropriate synthetic resin, is driven in a direction opposite to the direction of movement of belt 100 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamp 34*a*.

According to the present invention and referring now to FIG. 2, the developer replenishing system 130 is shown. The developer replenishing system 130 includes a developer supply container 132. The developer supply container 132 serves as a reservoir for replenishing fluid 134. The replenishing fluid 134 is a solution containing up to 50% toner solids 135 in a liquid developer carrier fluid 136 of a suitable hydrocarbon. For example, Norpar® 15, a trademark of Exxon Chemical International, Inc. is such a suitable fluid. The developer supply container 132 may have any suitable size or shape and may be constructed of any suitable durable material. Extending from the developer supply container is a conduit 137 which connects the developer supply container 132 to a mixing housing 138. Flow of the fluid 134 through the conduit 137 may be permitted by any suitable device such as an auger, a valve, or a piston. For example, a piston 140 may be slidably fit within the developer supply container 132 and a feed mechanism 142 may be positioned between the container 132 and the piston 140 to urge the replenishing fluid 134 toward the conduit 137. The fluid 134 includes agglomerates 144 which are groupings of the solids in the fluid 134 which are held tightly together.

The fluid 134 including the agglomerates 144 enters the mixing housing 138 through the conduit 137. A developer fluid 13*a* contained within the developer cartridge 14*d* enters the mixing housing 138 through a conduit 150. The developer fluid 13*a* is typically in the form of a solution of 1% toner 135 and 99% carrier fluid 136. The carrier fluid 136 is typically in the form of a hydrocarbon, such as Norpar® 15. The flow of developer fluid 13*a* through the conduit 150 is controlled by any suitable means, such as by valve 154. Conduits 137 and 150 deliver the replenishing fluid 134 and developer fluid 13*a*respectively, into upper portion 156 of the mixing housing 138.

Apparatus 160 for breaking up the agglomerates is located within the mixing housing 138 and separates the upper portion 156 of the mixing housing 138 with lower portion 162 of the mixing chamber. The developer fluid 13*a* and the replenishing fluid 134 are urged from the upper portion 156 of the mixing housing 138 toward screen 164 located in the apparatus 160. The developer fluid 13*a* and a portion of the replenishing fluid 134 pass through the screen 164, while the agglomerates 144 with a nominal portion of the replenishing fluid 134 are trapped on upper surface 166 of the screen 164.

An urging device 170, preferably in the form of a wiping blade is positioned on upper surface 166 of the screen 164. Relative motion is provided between the wiping blade 170 and the screen 164. The relative motion may be provided by either rotating the screen relative to the blade 170, by rotating the blade relative to the screen or by a combination of the above. The applicant has found that the rotation of the screen around a fixed blade is effective and this configuration is shown in FIG. 1. The screen 164 is caused to rotate around lower surface 167 of the blade by any suitable power source, such as motor 172. A shaft 174 may interconnect the motor 172 and the screen 164. Agglomerates 144 which rest on the upper surface 166 of the screen 164 are trapped between the screen 164 and the blade 170. The relative motion between the screen and the blade serves to grind the agglomerates into smaller particles. In fact the relative motion tends to break the agglomerates into small particles 180 having their original manufactured size. While the screen 164 typically includes circular apertures 176 having a diameter of approximately 32 microns, the original manufactured size of the agglomerates is approximately 2 microns or less. Small particles 180 which rest on the upper surface 166 of the screen 164 are urged by the wiping blade 170 through apertures in the screen 164. Although the circular apertures 176 have a diameter of approximately 32 microns, the small particles 180 passing through the screen typically have a size of approximately 2 microns or less, much smaller than the 32 microns which one would expect from the effect of the 32 micron holes in the screen 164. The 2 micron size is due to the grinding of the agglomerates 144 between the screen and the blade.

To assist in the grinding process, to promote movement of toner through the screen and to avoid reforming of agglomerates a first portion of the developer fluid 13*a* entering the mixing housing 138 through conduit 150 preferably flows through a first nozzle 181. The first nozzle 181 direct the fluid 13*a* into the upper portion 156 of the mixing housing 138. Preferably, the fluid 13*a* is directed onto the top of the blade 170 by the first nozzle 181.

The small particles 180 together with the replenishing fluid 134 from the supply container 132 and the developer fluid 13*a* from the developer cartridge 14*d* progress to the lower portion 162 of the mixing housing 138. A portion of the small particles 180 adhere to lower surface 182 of the screen 164. A cleaner 184 preferably in the form of a second wiping blade is located against the lower surface 182 of the screen 164. The second wiping blade 184 serves to remove the smaller particles 180 which have adhered to the lower surface 182 of the screen 164. The cleaner 184 preferably is stationary and the screen 1264 rotates, but it should be appreciated that, like the first wiping blade 170, the cleaning blade 184 may rotate while the screen 164 is either stationary or rotates.

To aid the second wiping blade 184 in removing the smaller particles 180 which have adhered to the lower surface 182 of the screen 164, a second portion of the developer fluid 13*a* entering the mixing housing 138 through a conduit 150 preferably flows through a second nozzle 185. The second nozzle 185 direct the fluid 13*a* into the lower portion 162 of the mixing housing 138. Preferably, the fluid 13*a* is directed onto the second wiping blade 184 by the second nozzle 185.

A mixer 186 is preferably located in the lower portion 162 of the mixing housing 138 and serves to agitate the smaller particles 180 with the developer fluid 13*a* and the replenisher fluid 134 in the lower portion 162 of the mixing housing 138 to form a homogeneous mixture of developer fluid 13*a*. The mixer 186 may have any suitable form such as a paddle wheel (not shown) or an impeller. The impeller 186 may be secured to shaft 174 and rotated by motor 172. Developer fluid 13*a* from the lower portion 162 of the mixing housing 138 enters conduit 190 and is drawn by gravity or any suitable pumping device, such as pump 192 into the developer cartridge 56. The motor 172 turns the screen 164 at any suitable speed to provide for the proper breaking up of the agglomerates 144. A rotational speed of the screen 164 of 20 rpm or less has been found to be effective in breaking up the agglomerates 144.

Referring now to FIG. 1, the apparatus 160 for breaking up agglomerates according to the invention is shown in greater detail. The apparatus 160 includes body 194. The body 194 may be an integral part of the mixing housing 138 (see FIG. 2) or be a separate component attached to the mixing housing 138. The body 194 may be made of any suitable durable material, such as a plastic, or a metal. It is important that the body 194 be non-reactive with the developer fluid 13*a* (see FIG. 2).

Referring again to FIG. 1, the screen 164 is permitted to rotate relative to lower portion 196 of the body 194 by any suitable means, such as by journals or bearings, or as shown in FIG. 1, by groove 200 into which outer periphery 202 of screen 164 matingly slides. The screen 164 is made of any suitable shape, such as a mesh. Applicant has found that a mesh screen 164 having circular apertures 176 with a diameter of 32 microns to be effective in breaking up the agglomerates. The screen 164 is made of any suitable durable material that is non-reactive with the developer fluid 13*a*, such as a metal or a plastic. Applicant has also found that the use of a stainless steel mesh screen is effective. Applicant believes, however, that a mesh screen made of Nylon may also be effective.

Centrally located within the screen 164 is the shaft 174. The shaft 174 may be made of any suitable durable material that is non-reactive with the developer fluid 13*a*such as a plastic or a metal, for example stainless steel. The shaft 174 may be supported by mixing housing 138 (see FIG. 2). The screen 164 may be interferencely fitted to the shaft 174 or be secured thereto by adhesives or fasteners. First wiping blade 170 is slidably fitted to shaft 174 through aperture 204 in the first wiping blade 170 and fixed in its position by any suitable means such as by being secured to the mixing housing 138. The wiping blade 170 may be made of any suitable durable material that is non-reactive with the developer fluid 13*a*. Applicant has found that a resilient material, such as spring steel, is effective in maintaining the contact between the wiping blade 170 and the screen 164. Applicant has found a wiping blade 170 made from spring steel with a thickness of 0.005 inches to be effective.

The wiping blade 170 includes a first edge 206 which extends from a point near the aperture 204 to a point distal from the aperture 204. The first edge 206 extends radially to a point near inner periphery 208 of the body 194. The wiping blade 170 also includes a second edge 210 opposite the first edge 206. The second edge 210 is spaced from the first surface 166 of the screen 164. The screen 164 is preferably permitted to rotate in the direction of arrow 212 so that second edge 210 of wiping blade 170 becomes the leading edge of the wiping blade 170. Agglomerates 144 (see FIG. 2) accumulate between the second edge 210 and the screen 164 and are urged toward the first edge 206 which is in contact with the screen 164. The agglomerates 144 are thereby squeezed between the first edge 206 and the screen 164, are ground into their manufactured size and pass thereby through the screen 164.

The first wiping blade 170 is preferably made from a unitary piece of spring steel with a thickness of approximately 0.005 inches. The blade 170 is bent along line 213 forming a first portion 214 and a second portion 216. The first portion 214 includes the first edge 206 with a surface of the first portion 214 in a generally planar contact with the first surface 166 of the screen 164. The second portion 216 includes the second edge 210 of the blade 170 and the second portion 216 defines a plane intersecting the screen 164. The second portion 216 and the screen 164 define an angle $\alpha$ therebetween.

The apparatus 160 also includes cleaner 184 in the form of a second wiping blade or a cleaning blade. The cleaning blade includes a first edge 220 extending radially from the shaft 174 to the inner periphery 208 of the body 194. The first edge 220 is in linear contact with the second surface 182 of the screen 164. The cleaning blade 184 is slidably fitted to the shaft 174 at the aperture 222 of the blade by any suitable means between aperture 222 in the blade 184 and the shaft 174 and is fixed in its position by any suitable means such as by being secured to the mixing housing 138. The cleaning blade 184 includes a second edge 224 spaced from and generally parallel to the first edge 222. The second edge 224 is spaced from the second surface 182 of the screen 164. The screen 164 rotates in the direction of arrow 212 with the first edge 220 forming the leading edge of the blade 184. The cleaning blade 184 may be made of any suitable durable material that is non-reactive with the developer fluid 13*a* such as a metal or a plastic. For example, the cleaning blade 184 has found to be effective when made from a spring steel having a thickness of approximately 0.005 inches.

The cleaning blade 184 may be made from a planar material and bent along line 230 forming a first planar surface 232 and a second planar surface 234. The second planar surface 234 is generally parallel to the screen 164, while the first planar surface 232, which includes the first edge 220, is positioned at an angle $\beta$ relative to the second surface 234. The screen 164 is preferably permitted to rotate in the direction of arrow 212, so that the small particles 180 (see FIG. 2) which have passed through screen 164 are removed from the second surface 182 of the screen 164 by the first edge 220 of the cleaning blade 184.

In recapitulation, it is clear that the present invention is directed to a development system employing liquid developer material. A donor belt or roll is spaced from a recording medium having a latent image recorded thereon. The donor member is electrically biased to a suitable polarity and magnitude so that the toner is attracted from the developer material adhering to the donor member to the recording medium. A liquid toner cartridge is operatively associated with the donor belt or roll so as to substantially uniformly coat the exterior surface thereof with liquid developer material. Toner is attracted from the liquid developer material to the electrostatic latent image. In this way, the recording medium is developed with a suitable toner. The development system includes a developer replenishing system whereby liquid developer with a substantially higher concentration of toner may be mixed with a liquid developer to replenish toner spent onto the recording medium. The liquid developer with a substantially higher concentration of toner includes agglomerates that are dispersed through the high solid toner redispersion screen of the present invention.

It is, therefore, apparent that there has been provided in accordance with the present invention a liquid development system which fully satisfies the aims and advantages hereinbefore set forth. While this invention has been described in conjunction with specific embodiments for use in various types of printing machines, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for breaking aggregated toner in a liquid carrier into smaller pieces, comprising:

a substantially planar screen defining a plurality of apertures therein with the smaller pieces of toner being passable therethrough;

a blade including a planar portion thereof in intimate contact with said screen and a second portion spaced from said screen, said blade and said screen having a movable relation therebetween which is parallel to a surface of said screen so as to trap and grind large particles of the aggregated toner between said blade and said screen into smaller particles substantially smaller than the apertures in said screen and to urge at least a portion of the smaller particles of toner through said screen;

a second blade in contact with a second surface of said screen opposed to said first mentioned surface of said screen including a planar portion thereof in intimate contact with said screen and a second portion spaced from said screen for cleaning the smaller pieces of toner from the second surface of said screen; and a nozzle for directing liquid carrier onto the second blade.

2. The apparatus of claim 1, further comprising a mixer for mixing the smaller pieces with the liquid carrier.

3. The apparatus of claim 2, wherein said mixer comprises an impeller.

4. The apparatus of claim 2, wherein said mixer comprises a paddle wheel.

5. The apparatus of claim 2, wherein said second blade comprises spring steel having a thickness of approximately 0.005 inches.

6. The apparatus of claim 1, wherein said blade comprises spring steel having a thickness of approximately 0.005 inches.

7. The apparatus of claim 1, wherein the apertures of said screen have a diameter of approximately 32 microns.

8. A developer unit of the type having a developer material of toner and liquid carrier with the toner developing a latent image recorded on a member to form a developed image, comprising:

means for transporting at least the toner closely adjacent to the latent image; and a device for supplying toner to said transporting means, said device breaking the toner in the liquid carrier into smaller pieces of toner, said device including a substantially planar screen defining a plurality of apertures therein with the smaller pieces of toner being passable therethrough, a blade including a planar portion thereof in intimate contact with said screen and a second portion spaced from said screen, said blade and said screen having a movable relation therebetween which is parallel to a surface of said screen so as to trap and grind large particles of the aggregated toner between said blade and said screen into smaller particles substantially smaller than the apertures in said screen and to urge at least a portion of the smaller particles of toner through said screen, a second blade in contact with a second surface of said screen opposed to said first mentioned surface of said screen including a planar portion thereof in intimate contact with said screen and a second portion spaced from said screen for cleaning the smaller pieces of toner from the second surface of said screen, and a nozzle for directing liquid carrier onto the second blade.

9. The developer unit of claim 8, wherein said device further comprises:

a first reservoir for storing the toner to be supplied to said transporting means; and a second reservoir for mixing the smaller pieces of toner with the liquid carrier.

10. The developer unit of claim 9, wherein said device further comprises a mixer located at least partially in said second reservoir for mixing the smaller pieces with the liquid carrier.

11. The developer unit of claim 10, wherein said mixer comprises an impeller.

12. The developer unit of claim 10, wherein said mixer comprises a paddle wheel.

13. The developer unit of claim 8, wherein said second blade comprises spring steel having a thickness of approximately 0.005 inches.

14. An electrophotographic printing machine of the type having a developer material of toner and liquid carrier with the toner developing an electrostatic latent image recorded on a photoconductive member, comprising:

means for transporting at least the toner closely adjacent to the latent image; and a device for supplying toner to said transporting means, said device breaking the toner in the liquid carrier into smaller pieces of toner, said device including a substantially planar screen defining a plurality of apertures therein with the smaller pieces of toner being passable therethrough, a blade including a planar portion thereof in intimate contact with said screen and a second portion spaced from said screen, said blade and said screen having a movable relation therebetween which is parallel to a surface of said screen so as to trap and grind large particles of the aggregated toner between said blade and said screen into smaller particles substantially smaller than the apertures in said screen and to urge at least a portion of the smaller particles of toner through said screen, a second blade in contact with a second surface of said screen opposed to said first mentioned surface of said screen including a planar portion thereof in intimate contact with said screen and a second portion spaced from said screen for cleaning the smaller pieces of toner from the second surface of said screen, and a nozzle for directing liquid carrier onto the second blade.

15. The developer unit of claim 14, wherein said device further comprises:

a first reservoir for storing the toner to be supplied to said transporting means; and a second reservoir for mixing the smaller pieces of toner with the liquid carrier.

16. The developer unit of claim 15, wherein said device further comprises a mixer located at least partially in said second reservoir for mixing the smaller pieces with the liquid carrier.

17. The developer unit of claim 16, wherein said mixer comprises an impeller.

18. The developer unit of claim 16, wherein said mixer comprises a paddle wheel.

19. The developer unit of claim 14, wherein said second blade comprises spring steel having a thickness of approximately 0.005 inches.

* * * * *